US010456837B2

(12) United States Patent
Ankudinov et al.

(10) Patent No.: US 10,456,837 B2
(45) Date of Patent: Oct. 29, 2019

(54) METHOD FOR PRODUCING MONODISPERSE SPHERICAL GRANULES

(71) Applicants: Vasiliy Borisovich Ankudinov, Podolsk (RU); Yuriy Aleksandrovich Marukhin, Moscow (RU); Vladimir Pavlovich Ogorodnikov, Podolsk (RU)

(72) Inventors: Vasiliy Borisovich Ankudinov, Podolsk (RU); Yuriy Aleksandrovich Marukhin, Moscow (RU); Vladimir Pavlovich Ogorodnikov, Podolsk (RU)

(73) Assignee: NATIONAL RESEARCH UNIVERSITY "MPEI", Moscow (RU)

( * ) Notice: Subject to any disclaimer, the term of this patent is extended or adjusted under 35 U.S.C. 154(b) by 803 days.

(21) Appl. No.: 15/071,801

(22) Filed: Mar. 16, 2016

(65) Prior Publication Data

US 2016/0325359 A1 Nov. 10, 2016

(30) Foreign Application Priority Data

May 6, 2015 (RU) ..... 2015117107

(51) Int. Cl.
*B22F 9/08* (2006.01)
*C22B 59/00* (2006.01)

(52) U.S. Cl.
CPC ..... *B22F 9/08* (2013.01); *C22B 59/00* (2013.01)

(58) Field of Classification Search
None
See application file for complete search history.

(56) References Cited

U.S. PATENT DOCUMENTS 6,027,699 A * 2/2000 Holcomb ..... B22F 3/115 118/627
6,062,487 A * 5/2000 Bedetti ..... B01J 2/02 239/101

(Continued)

FOREIGN PATENT DOCUMENTS

FR 2505672 A1 * 11/1982
RU 2115514 7/1998
RU 2174060 9/2001

OTHER PUBLICATIONS

Haas, Paul A., "Formation of Uniform Liquid Drops by Application of Vibration to Laminar Jets", Ind. Eng. Chem. Res., vol. 31, No. 3 , pp. 959-967, 1992.*

(Continued)

*Primary Examiner* — George Wyszomierski
(74) *Attorney, Agent, or Firm* — Dmitry S. Kryndushkin

(57) ABSTRACT

A method for producing monodisperse spherical granules includes heating a dispersed chemically active material that contains at least one rare-earth metal, melting the material in a pot to form a melt, forming a laminar jet when the melt flows through a die made of a high-melting metal, forming a flow of monodisperse drops when the jet disintegrates under an action of perturbations applied with a set frequency, collecting any granules formed after switching to a stationary granulation mode, wherein, before the melt is fed to the die, an outer surface of the melt is covered with a film of an oxide of a dispersed chemically active material, helium is bubbled within the melt, mechanical impurities are removed from the melt.

1 Claim, 2 Drawing Sheets

(56) References Cited

U.S. PATENT DOCUMENTS

| | | | | |
|---|---|---|---|---|
| 2012/0048882 | A1* | 3/2012 | Clarke | B01F 13/0062 422/502 |
| 2012/0075389 | A1* | 3/2012 | Clarke | B01F 13/0062 347/73 |
| 2014/0290897 | A1* | 10/2014 | Chuntonov | B22D 39/02 164/303 |
| 2015/0314317 | A1* | 11/2015 | Duan | B05B 7/066 239/3 |

OTHER PUBLICATIONS

English Translation of FR 2505672 (published Nov. 1982) from Espacenet.*

* cited by examiner

METHOD FOR PRODUCING MONODISPERSE SPHERICAL GRANULES

CROSS-REFERENCE TO RELATED APPLICATION

The instant application claims priority to Russian Patent Application Ser. No. 2015117107, filed May 6, 2015, the entire specification of which is expressly incorporated herein by reference.

FIELD OF THE INVENTION

The invention relates to powder metallurgy, in particular, to a method for producing monodisperse spherical granules applied in regenerative heat exchangers of cryogenic gas machines.

BACKGROUND OF THE INVENTION

Known in the present state of the art is a method for producing monodisperse spherical granules (Russian Federation Patent No. 2115514, published on Jul. 20, 1998) based on the physical effect of forced capillary disintegration of a jet under the action of applied perturbations. The method consists in dispersing a jet of molten chemically active material coming from a die under the action of perturbations applied to it at an optimum temperature of a cooling inert gas and collecting granules after achieving the stationary generation mode at the outlet of the heat exchange chamber, where oxygen is removed from the inert gas to a max. value of 0.0001 mol %; the die is made of a high-melting metal.

The disadvantage of that method is a low quality of the produced finely-dispersed and coarsely-dispersed granules.

The closest to the proposed invention in terms of the technical essence is the method for producing monodisperse spherical granules (Russian Federation Patent No. 2174060, published on Sep. 27, 2001), which consists in dispersing a jet of melt formed using a die made of a high-melting metal under the action of perturbations with a preset frequency applied to the jet of a chemically active material that contains at least one rare-earth element. The jet is disintegrated and the flow of drops is formed within an electrical field, where the flow is divided into at least two flows, the level of the melt in the pot is controlled, and when it reduces additional dispersed chemically active material is fed into the pot to restore the initial level.

The disadvantage of that method is a low quality of granules when the dispersion time exceeds one hour (the diameter of the granules deviates from the set value, some granules are not spherical and their chemical composition changes). Along with that, the output of good product decreases (less than 50%).

SUMMARY OF THE INVENTION

The technical objective of the invention is to extend the functional capabilities of the method for producing monodisperse granules from a chemically active material.

The technical result consists in an increased capacity of the method for producing monodisperse granules from a chemically active material and an improved quality of granules when the granulation time is longer.

The method for producing monodisperse spherical granules relates to powder metallurgy and allows to extend the functional capabilities of the method.

The method increases the capacity for producing monodisperse granules from a chemically active material and improves the quality of granules when the granulation time is longer.

The essence of the method for producing monodisperse spherical granules consists in applying the physical effect of forced capillary disintegration of a laminar jet. The method involves heating the dispersed chemically active material that contains at least one rare-earth metal, making the melt in the pot, forming the laminar jet when the melt flows through the die made of a high-melting metal, forming a flow of monodisperse drops at disintegration of the jet under the action of perturbations applied to the jet with a set frequency, collecting granules after switching to the stationary granulation mode, applying a film of an oxide of the dispersed rare-earth metal on the outer surface of the die, stirring the melt in the pot and removing mechanical impurities before feeding the melt into the die, applying a film of an oxide of the dispersed rare-earth metal on the outer surface of the die before feeding the melt into the same, bubbling helium in the melt and removing mechanical impurities, with the amplitude of the perturbations applied to the jet selected subject to the equation:

$$U_i=U[1-c(1-n_i/N)],$$

where U is the maximum value of the jet perturbation amplitude;

c is a nondimensional factor with a value within the range $0.3<c<0.7$ that determines the depth of the jet perturbation amplitude modulation;

$n_i$—0, 1, . . . , N is the ordinal number of a drop;

N is the quantity of the coalesced drops.

In accordance with an illustrative embodiment of the present invention, a method for producing monodisperse spherical granules is provided, comprising the steps of:

heating a dispersed chemically active material that contains at least one rare-earth metal;

melting the material in a pot to form a melt;

forming a laminar jet when the melt flows through a die made of a high-melting metal;

forming a flow of monodisperse drops when the jet disintegrates under an action of perturbations applied with a set frequency;

collecting any granules formed after switching to a stationary granulation mode;

wherein, before the melt is fed to the die, an outer surface of the melt is covered with a film of an oxide of a dispersed chemically active material, helium is bubbled within the melt, mechanical impurities are removed from the melt, and an amplitude of the perturbations applied to the jet is selected according to the equation:

$$U_i=U[1-c(1-n_i/N)],$$

where U is a maximum value of the jet perturbation amplitude;

c is a non-dimensional factor with a value within the range of $0.3<c<0.7$ that determines a depth of a jet perturbation amplitude modulation;

$n_i$—0, 1, . . . , N is an ordinal number of a drop; and

N is a quantity of any coalesced drops.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE INVENTION

Figure 1:
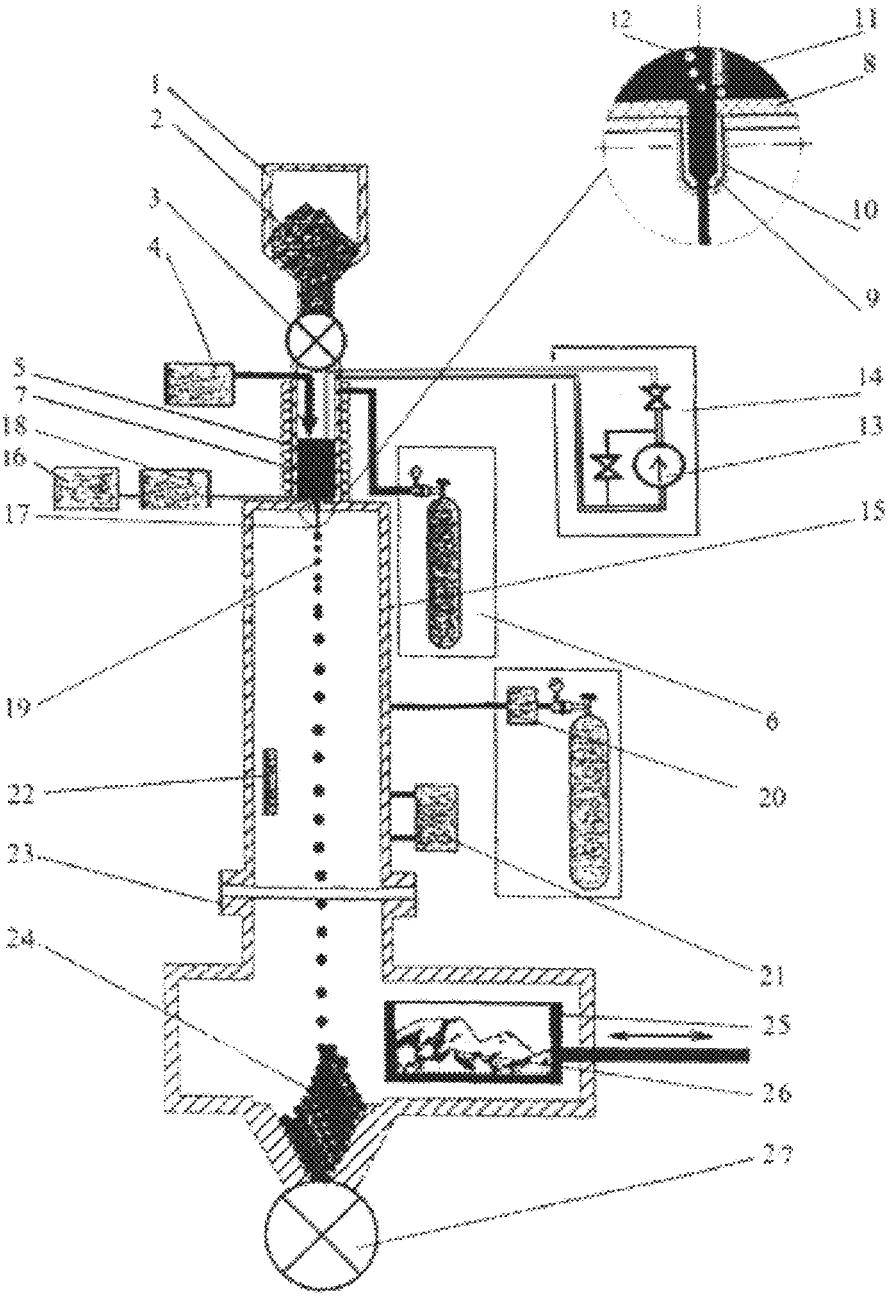
FIG. 1 shows an illustrative device that implements the proposed method of the present invention.

The following description of the preferred embodiment(s) is merely exemplary in nature and is in no way intended to limit the invention, or uses.

The essence of the method for producing monodisperse spherical granules consists in applying the physical effect of the forced capillary disintegration of the laminar jet. The dispersed chemically active material is melted in a heated pot. Then the melt is fed through the die. Under the action of perturbations applied with a set frequency to the jet of molten chemically active material that flows from the die, the same disintegrates into a flow of monodisperse drops. In the heat exchange chamber, the drops crystallize and form monodisperse granules, which accumulate at the outlet of the chamber.

The jet disintegrates into monodisperse drops under the action of sinusoidal perturbations. Each period of sinusoidal perturbation corresponds to formation of one drop during the jet disintegration. Modulating the jet perturbation amplitude allows to cyclically change the conditions under which a drop separates from the jet, and, according to the quantity of the periods within a modulation cycle, to coalesce the drops when they further fall in the heat exchange chamber. Accordingly, the distance between the drops that are formed after the coalescence increases, and the possibility of their coagulation caused by random fluctuations of the velocity is eliminated. Experiments have shown that the quantity of the coalesced drops should not exceed 4 within the granule diameter range from 50 μm to 500 μm. The modulation depth has to lie within the range from 0.3 U to 0.7 U (where U is the maximum value of the perturbation amplitude). When the jet is perturbated with an amplitude of $U_i<0.3$ U, the characteristics of the forced capillary disintegration of the jet deteriorate, and when $U_i>0.7$ U, the drops do not coalesce cyclically.

In the process of dispersion, particles that are not soluble in the melt of the dispersed material accumulate at the inlet of the flow channel of the die. This causes hydraulic noises within the laminar jet of the melt and deteriorates the characteristics of the forced capillary disintegration. Apart from that, deterioration of the characteristics of the forced capillary disintegration of the melt jet is caused by distortion of the jet velocity profile when the outer surface of the die is wetted with molten chemically active material.

Accordingly, in the process of long-term granulation, a greater variation of the drop diameters and velocities relatively to the mean values, and spontaneous coalescence of the drops are observed.

In the course of time, molten chemically active material consisting of several metals begins to stratify, which changes the chemical composition of the melt along the pot height and, accordingly, changes the chemical composition of the drops with time.

All these cause deterioration of the quality of the granules (the granule diameters deviate from the set value, some of the granules are not spherical and their chemical composition changes) when the dispersion time increases (more than one hour). The output of good product decreases (less than 50%).

Referring specifically to FIG. 1, the device that implements the proposed method for producing monodisperse spherical granules contains the tank 1 for feeding the initial dispersed chemically active material 2, which includes at least one of rare-earth metals: Y, La, Ce, Pr, Nd, Pm, Sm, Eu, Gd, Tb, Du, Ho, Er, Tm, Yb, the upper gate 3 installed at the outlet of the tank 1, the unit for measuring the level 4 of the melt 5 of the dispersed chemically active material 2 pressurized with gas by the unit 6. The melt 5 of the dispersed chemically active material 2 is located in the heated pot 7, at the bottom of which the filter 8 and the die 9 made of a high-melting metal, for example, molybdenum, tungsten or tantalum, are secured. On its outer surface, the die 9 has the film 10 of an oxide of the dispersed chemically active material 2. Inside the pot 7 there is a bubbling tube 11 for feeding the helium 12 bubbles to the melt 5 of the dispersed chemically active material 2 from the compressor 13 of the bubbling unit 14. The lower part of the pot 7 is connected to the inlet of the heat exchange chamber 15. The device contains the perturbation unit 16 for the jet 17 that flows from the die 9 and disintegrates into the drops 19, and the perturbation amplitude modulation unit 18. The heat exchange chamber 15 is connected to the purifying unit 20 for the cooling inert gas and to the temperature regulator 21, and has the unit 22 for controlling the size of the monodisperse spherical granules 19. The outlet 23 of the heat exchange chamber 15 provides collection of the monodisperse granules 24 and has the internal separator 25 for collecting the off-grade material 26 that is formed when the device starts operating, and the lower gate 27.

The device that implements the method for producing monodisperse granules operates as follows.

The initial dispersed chemically active material 2 is loaded into the additional feed tank 1 and the pot 7 when the upper 3 and lower 29 gates are closed. The pot 7, the additional feed tank 1, the bubbling unit 14 and the heat exchange chamber 15 with its outlet 23 are filled with the inert gas containing no more than 0.0001 mol % of oxygen through the purifying unit 20. Helium is used as the inert gas.

The initial monodispersed material 2 is melted in the pot 7. The level of the melt 5 of the dispersed chemically active material 2 is measured with the measuring unit 4, and the dispersed chemically active material 2 is added from the tank for additional loading 1 to the pot 7 to achieve the set level. The helium is fed from the bubbling unit 14 to the lower part of the pot 7 through the tube 11, and the melt 5 of the dispersed chemically active material 2 is stirred up with bubbling of the helium 12. Using the pressurizing unit 6, the melt 5 of the dispersed chemically active material 2 is fed through the filter 8 to the die 9, the outer surface of which has been preliminarily covered with the oxide film 10, and the laminar jet 17 of the molten dispersed chemically active material 2 is formed and disintegrated into monodisperse drops, which coalesce at least by two under the action of perturbations with a set frequency and amplitude U formed by the modulation unit 18 and determined from the equation $$U_i=U[1-c(1-n_i/N)],$$

where U is the maximum value of the jet perturbation amplitude;

c is a nondimensional factor with a value within the range $0.3<c<0.7$ that determines the depth of the jet perturbation amplitude modulation;

$n_i$ is 0, 1, . . . , N, the ordinal number of a drop;

N is the quantity of the coalesced drops.

The off-grade granules 26 that are formed when the device starts operating are collected in the separator 25.

After all the device mode parameters are stabilized and the stationary mode of generation and coalescence of monodisperse drops 19 is set, monodisperse spherical granules 24 are formed with the size determined by the control unit 22, and collected at the outlet 23 of the heat exchange chamber 15. The monodisperse granules 24 are unloaded through the lower gate 27.

As the set value of the chemical composition corresponds to the maximum heat capacity value of the granule material, deviation of the chemical composition from the set value reduces the heat capacity of the granules and deteriorates their quality. High heat capacity level is one of the main conditions of an effective application of the granules as matrices in regenerative heat exchangers of cryogenic gas machines with a working temperature lower than T=10 K. The melt 5 of the chemically active material 2 is stirred, and a constant chemical composition across the same is maintained by bubbling helium fed to the lower part of the pot 7 through the bubbling tube 11. The helium is fed to the bubbling tube 11 from the compressor 13, which is connected in closed circulation loop configuration. The use of the helium bubbling allows to eliminate stratification of the liquid melts of rare-earth metals and ensures their constant chemical composition with an error max. 1% for the whole granulation time, which can exceed 10 hours.

The filter 8 through which the melt 5 of the dispersed chemically active material 2 is fed to the die 9 stops the particles insoluble in the melt. This allows for the stabilization of the characteristics of the forced capillary disintegration of the jet of the melt 5 of the dispersed chemically active material 2 for a long time and ensures the required quality of the monodisperse granules. Meshes of a high-melting metal (for example, tungsten, molybdenum or tantalum) may be used as the filter 8. The size of the mesh orifice h must be within the range $h<0.5$ d, where d is the die hole diameter. This condition is determined by the fact that if the filter 9 orifice is larger, insoluble particles pass through the filter 8 and accumulate at the inlet of the die 9. The lower limit of the filter 8 mesh orifice size is determined by process capabilities of making the meshes.

The outer surface of the die 9 is covered with the oxide film 10 that has a thickness H, which must be within the range 0.1 μm<H<1 μm.

Thin oxide films 10 (H<0.1 μm) are washed away under the action of the melt 5 during the dispersion. If the thickness H>1 μm, the oxide film 10 can disintegrate as the linear expansion factors of the oxide film 10 and the material of the die 10 differ. Besides, a thick oxide film distorts the geometry of the outlet of the flow channel of the die, thus deteriorating the characteristics of the forced capillary disintegration of the jet 17. A specific feature of the single-component melt 5 of rare-earth metal is that it intensely wets the outer surface of the die 9. The melt 5 of the dispersed chemically active material 2 spreads all over the butt end of the die 9 and can even climb up its outer surface by several mm. At the first stage of the granulation process (the stage time does not exceed 15 min) the jet distorts and the characteristics of the forced capillary disintegration of the jet 17 of the melt 5 deteriorate. Then the dripping mode is activated and the granulation process stops.

The oxide film 10 of the dispersed chemically active material allows to minimize wetting of the material of the die 9 with the melt 5. In such a case, the spread of the melt 5 on the outer surface of the die 9 is eliminated, the characteristics of the forced capillary disintegration of the jet stabilize, and the required quality of granules is ensured for a long time.

The experimental data on producing monodisperse spherical granules from HoCu2 alloy and single-component Nd melt are shown in the Table, below:

TABLE

| Material | D μm | T hour | G kg | H μm | h μm | X % | N | c | δ1 % | δ2 % | K % |
|---|---|---|---|---|---|---|---|---|---|---|---|
| $HoCu_2$ | 240 | 12 | 26 | 0.7 | 30 | 0.4 | 2 | 0.5 | 1.7 | 1.01 | 96 |
| Nd | 270 | 11 | 28 | 0.9 | 30 | — | 2 | 0.6 | 1.5 | 1.01 | 97 |

The Table provides the set granule diameter D, the granulation time T, the quantity G of monodisperse granules produced during the granulation, the oxide film thickness H, the size of the filter mesh orifice h, the maximum deviation X of the granule chemical composition from the set value, the quantity of the coalesced drops N, the nondimensional factor c that determines the depth of the jet perturbation amplitude modulation, the mean-square deviation δ1 of the granule diameters from the set value, the maximum ratio of the large and small diameters of the granules δ2, and the output of good product K.

The use of the invention allows for the improvement of the quality of granules during long-term granulation and, moreover, to produce monodisperse spherical granules from single-component melts of rare-earth metals. It broadens the range for regulating the diameter of the produced granules without replacing the die (for example, when four drops coalesce, the diameter of monodisperse granules increases by 60%). Along with that, the mean-square deviation of the granule diameters from a set value does not exceed 2%, the ratio of the large and small diameters of the granules does not exceed 1.02, the deviation of the chemical composition from the preset one does not exceed 1%, and the output of good product with granulation longer than 10 hours is at least 95%.

Figure 2:
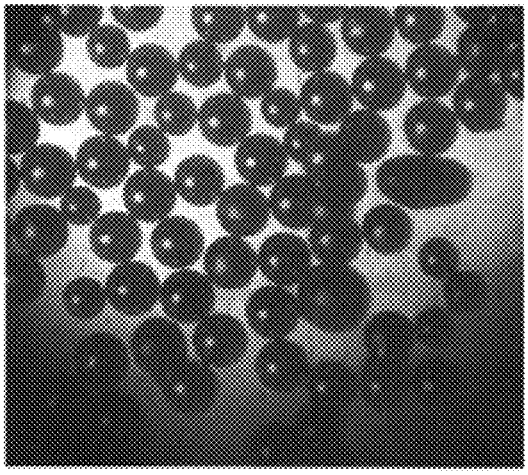
FIG. 2 shows $HoCu_2$ granules produced without coalescence of drops, without filtration of the melt upstream of the die and without an oxide film on its outer surface (the time after the beginning of the dispersion is T=2 hours)

Referring specifically to FIG. 2, there is shown $HoCu_2$ granules produced without coalescence of drops, without filtration of the melt upstream of the die and without an oxide film on its outer surface (the time after the beginning of the dispersion is T=2 hours).

Figure 3:
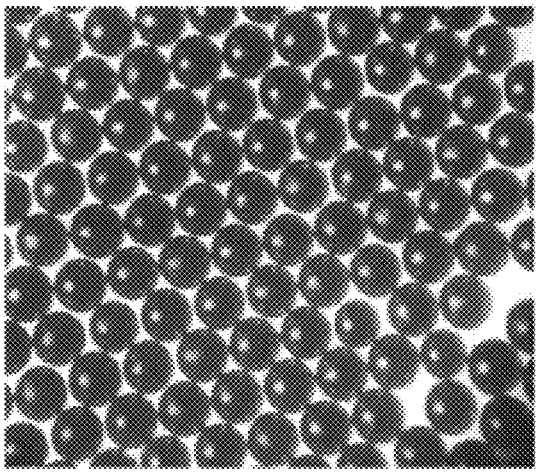
FIG. 3 shows monodisperse $HoCu_2$ granules with a diameter of 250 μm produced by coalescence of drops by two, covering the outer surface of the die with $Ho_2O_3$ oxide film with a thickness H=0.7 μm and filtering the melt (T=12 hours)

Referring specifically to FIG. 3, there is shown monodisperse $HoCu_2$ granules with a diameter of 250 μm produced by coalescence of drops by two, covering the outer surface of the die with $Ho_2O_3$ oxide film with a thickness H=0.7 μm and filtering the melt (T=12 hours).

Figure 4:
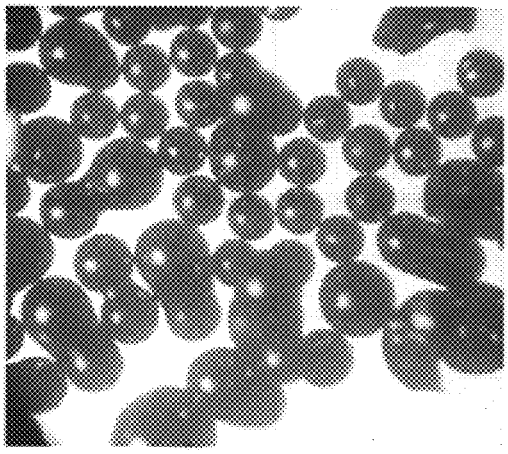
FIG. 4 shows Nd granules produced without coalescence of drops, without filtration of the melt upstream of the die and without an oxide film on its outer surface (T=12 min)

Referring specifically to FIG. 4, there is shown Nd granules produced without coalescence of drops, without filtration of the melt upstream of the die and without an oxide film on its outer surface (T=12 min).

Figure 5:
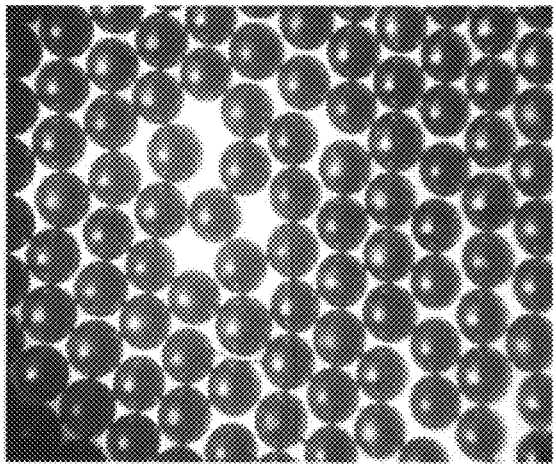
FIG. 5 shows monodisperse Nd granules with a diameter of 270 μm produced by coalescence of drops by two, covering the outer surface of the die with $Nd_2O_3$ oxide film with a thickness H=0.9 μm and filtration of the melt (T=11 hours).

Referring specifically to FIG. 5, there is shown monodisperse Nd granules with a diameter of 270 μm produced by coalescence of drops by two, covering the outer surface of the die with $Nd_2O_3$ oxide film with a thickness H=0.9 μm and filtration of the melt (T=11 hours).

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for producing monodisperse spherical granules, comprising the steps of:

heating dispersible chemically active material that contains at least one rare-earth metal;

melting the material in a pot to form a melt;

covering an outer surface of a die made of a high-melting metal selected from the group consisting of molybdenum, tungsten and tantalum with a film of a material that contains an oxide of said at least one rare-earth metal;

bubbling helium through the melt to remove insoluble particles from the melt;

flowing the melt through the die to form a laminar jet;

disintegrating the jet under an action of perturbations applied with a set frequency to form a flow of monodisperse drops;

collecting monodisperse granules formed via coalescence of said monodisperse drops;

wherein an amplitude of the perturbations applied to the jet is selected according to the equation:

$$U_i=U[1-c(1-n_i/N)],$$

where U is a maximum value of the jet perturbation amplitude;

c is a non-dimensional factor with a value within the range of $0.3<c<0.7$ that determines a depth of a jet perturbation amplitude modulation;

$n_i$—0, 1 . . . N is an ordinal number of a drop; and N is a quantity of coalesced drops; and is selected such that the mean square deviation of granule diameters of said monodisperse granules from a set value does not exceed 2%.

* * * * *